United States Patent [19]

Faivre

[11] 3,956,941

[45] May 18, 1976

[54] ESCAPEMENT-TYPE DRIVE MECHANISM FOR WATCHES AND THE LIKE

[75] Inventor: Christian Faivre, Morteau, France

[73] Assignee: Les Fabriques d'Assortments Reunies, LeLocle, Switzerland

[22] Filed: Dec. 18, 1974

[21] Appl. No.: 533,771

[30] Foreign Application Priority Data

Jan. 18, 1974 Switzerland ..... 672/74

[52] U.S. Cl. ..... 74/1.5; 58/116 R; 58/121 R

[51] Int. Cl.[2] ..... G04B 15/00

[58] Field of Search ..... 74/1.5; 58/116 R, 116 M, 58/117, 121 R, 121 A

[56] References Cited

UNITED STATES PATENTS

| | | | |
|---|---|---|---|
| 3,446,007 | 5/1969 | Cohen | 74/1.5 X |
| 3,611,707 | 10/1971 | Scholz | 74/1.5 X |
| 3,704,582 | 12/1972 | Wuthrich | 74/1.5 X |
| 3,708,974 | 1/1973 | Fujimori | 74/1.5 X |
| 3,775,968 | 12/1973 | Tuetey | 58/116 R |

*Primary Examiner*—Allan D. Herrmann
*Attorney, Agent, or Firm*—Karl F. Ross; Herbert Dubno

[57] ABSTRACT

An escapement-type drive mechanism for watches and the like comprises an escapement wheel formed with a circumferential array of teeth spaced apart by respective radial slots and having displacement faces inclined to respective radii. An angularly oscillatable inverse anchor-shaped lever is engageable with the wheel for intermittently rotating it. The lever is formed with a pair of spaced-apart pallets (pins) mounted for lost motion on the lever and alternately engageable with the faces and receivable in the slots to step the wheel upon angular oscillation of the lever. Magnetic means on the lever yieldably biases each of the pallets in a respective direction of its lost motion relative to the lever.

9 Claims, 1 Drawing Figure

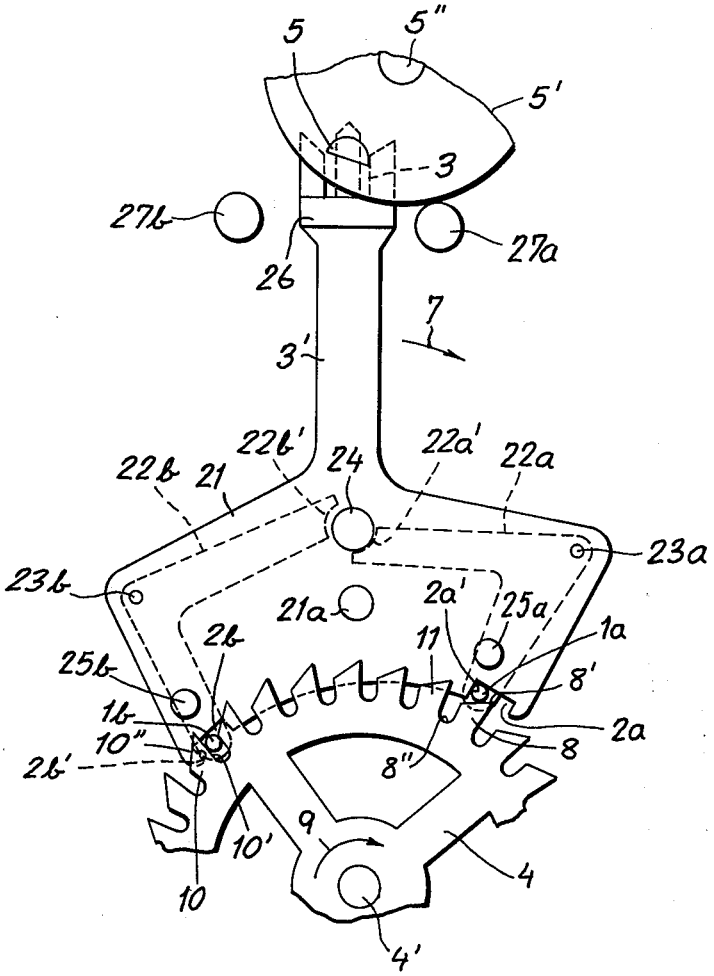
5
5"
5'
3
27b
27a
26
7
3'
22b'
22a'
22a
22b
21
24
23a
23b
21a
2a'
25a
1a
2b
11
8'
25b
1b
10"
2a
8
2b'
8"
9
10'
4
10
4'

ESCAPEMENT-TYPE DRIVE MECHANISM FOR WATCHES AND THE LIKE

FIELD OF THE INVENTION

The present invention relates to a drive mechanism for watches and especially watches of the so-called electric type which include electric, electronic or quartz-oscillator power systems. More particularly, the drive mechanism is an escapement having an inverse lever with two moveable pallets which cooperate with an escapement wheel having radial slots separating the stepping teeth from one another.

BACKGROUND OF THE INVENTION

As described in U.S. Pat. No. 3,775,968, for example, and elsewhere, it is known to use an escapement for watches in which an inverse lever constitutes the stepping device.

Two main problems are encountered with conventional stepping mechanisms. Firstly, the main driving force may intermittently release the oscillatable lever and hence it is necessary to provide stable end positions of the lever. Secondly, it is frequently found that misses or undesirable releases of the wheel can occur at the moment of impulse so that the escapement wheel carries out a reciprocating motion instead of a unidirectional rotation.

The first problem has been solved by the use of permanent magnets built into the watch movement and a magnet carried by the lever. The interaction between the two types of magnets serves to lock the lever at the ends of its oscillation stroke.

The second problem has been solved variously, e.g. by the use of braking springs which act upon the shaft of the drive wheel. In a second solution, moveable pallets are resiliently biased by a spring on the lever and are displaceable in respective slots in a plane parallel to the plane of lever. This system allows the pallets to engage the wheel even during the impulse but also permits release of the wheel as required for the stepping motion.

The first approach has some disadvantages as are discussed in the above-mentioned patent whereas the second approach creates difficulties with respect to fabrication of the pallets and the resilient means.

OBJECTS OF THE INVENTION

It is, therefore, an object of the present invention to provide a drive mechanism or escapement for watches, especially intermittently driven watches of the electric, electronic or quartz type, whereby the aforementioned disadvantages can be obviated.

Another object of the invention is to provide an escapement mechanism which can be fabricated simply and reproducibly, with a minimum of difficulty.

It is another object of the invention to provide an escapement in which the lever and the wheel are retained securely in the limiting positions of the lever and which nevertheless can step the wheel without misses or other effects leading to reciprocation of the wheel rather than unidirectional advance thereof.

SUMMARY OF THE INVENTION

These objects are attained, in accordance with the present invention, by replacing the resilient means previously retaining the pallets upon the lever or biasing them thereon, with magnetic means. More particularly, the flexible means integral with the lever are constituted by movable pieces subjected to the action of a magnetic field, the return force necessary to shift the pallets being created by the effect of the magnetic field on these movable pieces.

According to the invention, therefore, the escapement comprises an escapement wheel formed with a circumferential array of teeth spaced apart by respective radial slots and having displacement faces inclined to respective radii, an angularly oscillatable inverse anchor-shaped lever engageable with the wheel for intermittently rotating the same, the lever being formed with a pair of spaced apart pallets mounted for lost motion on the lever and alternately engageable with the faces and receivable in the slots to step the wheel with angular oscillation of the lever. Magnetic means on the lever yieldably biases each of said pallets in a respective direction of its lost motion relative to the lever, and a means is provided for angularly oscillating the lever.

According to a feature of the invention, the abovementioned pieces and the element upon which the magnetic field acts, are arms fulcrumed upon the lever and carrying the pallets, the arms having ends reaching toward a permanent magnet but swingable towards and away from the latter. The permanent magnet is carried by the lever.

According to still another of the invention, the lever is provided with a pair of recesses or slots whose flanks form stops for the respective pallets in the extreme positions of their lost motion.

Still another feature of the invention resides in providing the moveable pieces (carrying the pallets) of a metal of high magnetic permeability while the magnetic field is created by a permanent magnet fixed to the lever. Of course, it is also possible to provide a body of high magnetic permeability on the lever and to form the pieces with the permanent magnets.

The lever may carry a pair of pins or other abutment members receivable between the teeth of the wheel and designed to lock the wheel upon movement and, in turn, to be locked by the wheel temporarily. These abutments may fit snugly between the radial flank of one tooth and the inclined flank of a preceeding tooth.

BRIEF DESCRIPTION OF THE DRAWING

The above and other objects, features and advantages of the present invention will become more readily apparent from the following description, reference being made to the accompaning drawing in which the sole FIGURE is a fragmentary plan view of a escapement embodying the invention.

SPECIFIC DESCRIPTION

The drawing shows a drive or balance wheel 5' rotatable on an axle 5'' and carrying a roller pin 5 engageable between the legs of a fork 3 whose shank 3' forms the lever or anchor-shaped body 21. The operation of the wheel 5' and the pivotal mounting of the lever 21 are conventional in the art.

The lever 21 is provided with a pair of pallets 1*a*, 1*b*, received in respective spaced apart slots 2*a* and 2*b*. The rachet wheel is represented at 4 and is rotatable on its axle 4' in the direction shown by arrow 9.

A pair of bellcrank arms 22*a* and 22*b*, composed of soft iron, are mounted on respective pins 23*a* and 23*b*, on the underside of the lever 21 and have free ends 22*a'* and 22*b'* curved to conform to the configuration of a permanent magnet stud 24 also carried by the lever 21. The pivot 21*a* of this lever lies directly in line with the axis of stud 24 and axle 4′.

A pair of stops 27*a* and 27*b* spacedly flank the shank 3′ of the lever and function in the manner described below.

Each of the pallets 1*a*, 1*b*, in the form of pins which may be bent from or mounted on the bellcrank levers 22*a* and 22*b* has limited mobility between the flanks of the recesses 2*a* and 2*b* as will be apparent from the drawing.

In operation, the roller pin 5 engages the fork 3 and entrains it in the clockwise direction represented by the arrow 7. The pallet 1*a*, engaged by the inner edge 2*a*′ of its slot 2*a*, pushes along the ramps surface 8′ of a tooth 8 of the wheel 4 and thereby cams the wheel 4 in the direction of arrow 9, i.e. in the clockwise sense. At the same time, the leading radial flank 10′ of a tooth 10 entrains the pallet 1*b* in the clockwise sense within the slot 2*b*, thereby rotating the bellcrank 22*b* in the counterclockwise sense about its pivot 23*b*, increasing the distances between the magnetic stud 24 and the magnetically attractable end 22*b*′ of the bellcrank 22*b*.

Of course the bellcrank lever 22*a* is in its extreme clockwise postion about the pivot 23*a* and thus has its end 22*a*′ held against the magnetic stud 24. Consequently, the magnetic force between the stud 24 and the bellcrank lever 22*a* is at a maximum while the magnetic force between the stud 24 and the bellcrank lever 22*b* moves toward a minimum.

As movement in the indicated direction continues, the pallet 1*b* clears the oncoming tooth 10 while the pallet 1*a* passes into the radical slot 8″ behind the tooth 8. The pallet 1*b* jumps over the point of tooth 10 and lies upon its ramp 10″. Since there is a magnetic attractive field between the bellcrank lever 22*b* and the stud 24, and the pin or pallet 1*b* is released from the tooth 10, the magnetic attracting force swings the bellcrank lever 22*b* in the clockwise sense about the pin 23*b* until the pallet 1*b* comes to rest against the trailing edge 2*b*′ of the slot 2*b*. The lever 21 then engages with its permanent magnet 26 the magnetically attractable abutment 27*a* and the lever 21 is held in its extreme clockwise position. The wheel 4 is there locked against rotation in either direction by a pin fixed to lever 21 which lodges between the leading flank of the next tooth 11 and the trailing portion of tooth 8.

When the wheel 5′ engages the fork 3 to swing the lever 21 in the opposite direction, the pin or pallet 1*b* rides along the inclined flank 10″ of tooth 10, thereby advancing the wheel 4 in direction of arrow 9 and withdrawing pin 25*a* from engagement with tooth 11 and simultaneously raising the pallet 1*a* out of its slot 8″. The sequence is thus repeated with, however, reversal of the roles of pallets 1*a* and 1*b*, until the pallet 1*b* is lodged in the slot behind tooth 10 and the pin 25*b* locks the wheel 4 against rotation. In this case the permanent magnet 26 is magnetically retained against the abutment 27*b*.

The magnetic forces with which the bellcrank levers 22*a* and 22*b* are drawn toward the stud 24 are not linear and rapidly decrease with inreasing distance over the stud. This characteristic improves efficiency and smoothness of operation. Furthermore, the residual force is largest when the balance wheel 5′ has its highest momentum, particularly when the roller pin 5 strikes the fork 3.

In a device described, the moveable members 22*a* and 22*b* are of soft magnetic material while the fixed piece 24 is a hard or permanent magnet. Of course the ends 22*a*′ and 22*b*′ of members 22*a* and 22*b* can be permanent magnets (hard magnetic material) while the stud 24 is composed of soft magnetic material. The same type of reversal may be used such that member 26 is a magnetically attractable piece while members 27*a* and 27*b* are permanent magnets.

I claim:

1. An escapement-type drive mechanism comprising:
   an escapement wheel formed with a circumferential array of teeth spaced apart by respective radial slots and displacement faces inclined to respective radii;
   an angularly oscillatable lever engageable with said wheel for intermittently rotating same, said lever being formed with a pair of spaced-apart pallets mounted for lost motion on said lever and alternately engageable with said faces and receivable in said slots to step said wheel upon angular oscillation of said lever; and
   magnetic means on said lever yieldably biasing each of said pallets in a respective direction of its lost motion relative to said lever, said lever being formed with a pair of elements each carrying a respective one of said pallets, and a single member fixed on said lever and magnetically cooperating with both said elements.

2. The mechanism defined in claim 1 wherein said elements are composed of metal of high magnetic permability and said member is a permanent magnet.

3. The mechanism defined in claim 1 wherein said member is a material of high magnetic permeability and said elements are permanent magnets.

4. An escapement-type drive mechanism comprising:
   an escapement wheel formed with a circumferential array of teeth spaced apart by respective radial slots and displacement faces inclined to respective radii;
   an angularly oscillatable lever engageable with said wheel for intermittently rotating same, said lever being formed with a pair of spaced-apart pallets mounted for lost motion on said lever and alternately engageable with said faces and receivable in said slots to step said wheel upon angular oscillation of said lever; and
   magnetic means on said lever yieldably biasing each of said pallets in a respective direction of its lost motion relative to said lever, said lever being formed with a pair of elements each carrying a respective one of said pallets, and a member fixed on said lever and magnetically cooperating with said elements, said lever being formed with a pair of pins alternatively engageable between teeth of said wheel for locking said wheel relative to said lever in alternate extreme positions of said lever.

5. The mechanism defined in claim 4 wherein said elements are bellcrank levers pivotally mounted on said lever and having free arms reaching toward said member.

6. The mechanism defined in claim 5 wherein said lever is formed with a pair of recesses respectively receiving said pallets and having at least one flank engageable with the respective pallet upon the contact of the latter with a respective face of a tooth to step said wheel.

7. The mechanism defined in claim 6, further comprising a pair of abutments flanking said lever and defining extreme angular positions thereof.

8. The mechanism defined in claim 7, further comprising magnetic means for releasably retaining said lever alternately against said abutments.

9. The mechanism in claim 8 wherein said lever has a fork and said mechanism further comprises a balance wheel engageable with said fork to oscillate said lever.

* * * * *